US007824257B2

(12) United States Patent
Jubinville et al.

(10) Patent No.: US 7,824,257 B2
(45) Date of Patent: Nov. 2, 2010

(54) ON-LINE LOTTERY GAME IN WHICH SUPPLEMENTAL LOTTERY-SELECTED INDICIA ARE AVAILABLE FOR PURCHASE

(75) Inventors: Chantal Jubinville, Hoboken, NJ (US); Stephen Penrice, Morristown, NJ (US)

(73) Assignee: Scientific Games International, Inc., Newark, DE (US)

( * ) Notice: Subject to any disclaimer, the term of this patent is extended or adjusted under 35 U.S.C. 154(b) by 1308 days.

(21) Appl. No.: 11/330,428

(22) Filed: Jan. 11, 2006

(65) Prior Publication Data

US 2006/0151944 A1 Jul. 13, 2006

Related U.S. Application Data

(60) Provisional application No. 60/642,960, filed on Jan. 11, 2005.

(51) Int. Cl.
*A63F 3/00* (2006.01)

(52) U.S. Cl. ..... 463/17; 463/18; 463/25

(58) Field of Classification Search ..... 273/139, 273/269; 463/17, 18, 25
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | Nugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |
| 4,176,406 | A | 11/1979 | Matkan |

(Continued)

FOREIGN PATENT DOCUMENTS

AU B-18428/92 12/1992

(Continued)

OTHER PUBLICATIONS

'Are You In?', (Article).

(Continued)

*Primary Examiner*—James S McClellan
*Assistant Examiner*—Lawrence Galka
(74) *Attorney, Agent, or Firm*—Dority & Manning, P.A.

(57) ABSTRACT

There is provided a lottery game with a supplemental game. The player plays the lottery game by selecting a plurality of numbers and the player also has the option of playing the supplemental game. The lottery authority selects a set of winning numbers for the lottery game and also selects a set of supplemental numbers. If the player has opted to play the supplemental game, his numbers will not only be compared with the winning numbers but also with the supplemental numbers. The total number of matches between the player's numbers and winning numbers and supplemental numbers determines the player's prize.

8 Claims, 7 Drawing Sheets

U.S. PATENT DOCUMENTS

| | | | | |
|---|---|---|---|---|
| 4,191,376 | A | | 3/1980 | Goldman et al. |
| 4,194,296 | A | | 3/1980 | Pagnozzi et al. |
| 4,195,772 | A | | 4/1980 | Nishimura |
| 4,206,920 | A | | 6/1980 | Weatherford et al. |
| 4,241,942 | A | | 12/1980 | Bachman |
| 4,243,216 | A | | 1/1981 | Mazumder |
| 4,273,362 | A | | 6/1981 | Carrier et al. |
| 4,309,452 | A | | 1/1982 | Sachs |
| 4,313,087 | A | | 1/1982 | Weitzen et al. |
| 4,355,300 | A | | 10/1982 | Weber |
| 4,375,666 | A | | 3/1983 | Buck et al. |
| 4,398,708 | A | | 8/1983 | Goldman et al. |
| 4,407,443 | A | | 10/1983 | McCorkle |
| 4,451,759 | A | | 5/1984 | Heynisch |
| 4,455,039 | A | | 6/1984 | Weitzen et al. |
| 4,457,430 | A | | 7/1984 | Darling et al. |
| 4,464,423 | A | | 8/1984 | LaBianca et al. |
| 4,466,614 | A | | 8/1984 | Bachman et al. |
| 4,488,646 | A | | 12/1984 | McCorkle |
| 4,491,319 | A | | 1/1985 | Nelson |
| 4,494,197 | A | | 1/1985 | Troy et al. |
| 4,536,218 | A | | 8/1985 | Ganho |
| 4,544,184 | A | | 10/1985 | Freund et al. |
| 4,579,371 | A | | 4/1986 | Long et al. |
| 4,591,189 | A | | 5/1986 | Holmen et al. |
| 4,634,149 | A | | 1/1987 | Donovan |
| 4,665,502 | A | | 5/1987 | Kreisner |
| 4,669,729 | A | | 6/1987 | Solitt et al. |
| 4,689,742 | A | | 8/1987 | Troy et al. |
| 4,726,608 | A | | 2/1988 | Walton |
| 4,736,109 | A | | 4/1988 | Dvorzsak |
| 4,740,016 | A | | 4/1988 | Konecny et al. |
| 4,760,247 | A | | 7/1988 | Keane et al. |
| 4,763,927 | A | | 8/1988 | Schneider |
| 4,775,155 | A | | 10/1988 | Lees |
| 4,792,667 | A | | 12/1988 | Chen |
| 4,805,907 | A | | 2/1989 | Hagiwara |
| 4,817,951 | A | | 4/1989 | Crouch et al. |
| 4,835,624 | A | | 5/1989 | Black et al. |
| 4,836,546 | A | | 6/1989 | DiRe et al. |
| 4,836,553 | A | | 6/1989 | Suttle et al. |
| 4,837,728 | A | | 6/1989 | Barrie et al. |
| 4,856,787 | A | | 8/1989 | Itkis |
| 4,861,041 | A | | 8/1989 | Jones et al. |
| 4,870,260 | A | | 9/1989 | Niepolomski et al. |
| 4,880,964 | A | | 11/1989 | Donahue |
| 4,888,244 | A | | 12/1989 | Klinge |
| 4,922,522 | A | | 5/1990 | Scanlon |
| 4,943,090 | A | | 7/1990 | Fienberg |
| 4,960,611 | A | | 10/1990 | Fujisawa et al. |
| 4,961,578 | A | | 10/1990 | Chateau |
| 4,964,642 | A | | 10/1990 | Kamille |
| 4,996,705 | A | | 2/1991 | Entenmann et al. |
| 4,998,010 | A | | 3/1991 | Chandler et al. |
| 4,998,199 | A | | 3/1991 | Tashiro et al. |
| 5,032,708 | A | | 7/1991 | Comerford et al. |
| 5,037,099 | A | | 8/1991 | Burtch |
| 5,046,737 | A | | 9/1991 | Fienberg |
| 5,074,566 | A | | 12/1991 | Desbiens |
| 5,083,815 | A | | 1/1992 | Scrymgeour et al. |
| 5,092,598 | A | | 3/1992 | Kamille |
| 5,094,458 | A | | 3/1992 | Kamille |
| 5,100,139 | A | | 3/1992 | Di Bella |
| 5,109,153 | A | | 4/1992 | Johnsen et al. |
| 5,112,050 | A | | 5/1992 | Koza et al. |
| 5,116,049 | A | | 5/1992 | Sludikoff et al. |
| 5,118,109 | A | | 6/1992 | Gumina |
| 5,119,295 | A | * | 6/1992 | Kapur ..... 463/41 |
| 5,158,293 | A | | 10/1992 | Mullins |
| 5,165,967 | A | | 11/1992 | Theno et al. |
| 5,186,463 | A | | 2/1993 | Marin et al. |
| 5,189,292 | A | | 2/1993 | Batterman et al. |
| 5,193,815 | A | | 3/1993 | Pollard |
| 5,193,854 | A | | 3/1993 | Borowski, Jr. et al. |
| 5,228,692 | A | | 7/1993 | Carrick et al. |
| 5,232,221 | A | | 8/1993 | Sludikoff et al. |
| 5,234,798 | A | | 8/1993 | Heninger et al. |
| 5,249,801 | A | | 10/1993 | Jarvis |
| 5,259,616 | A | | 11/1993 | Bergmann |
| 5,269,523 | A | * | 12/1993 | Boylan et al. ..... 273/138.1 |
| 5,273,281 | A | | 12/1993 | Lovell |
| 5,276,980 | A | | 1/1994 | Carter et al. |
| 5,282,620 | A | | 2/1994 | Keesee |
| 5,308,992 | A | | 5/1994 | Crane et al. |
| 5,317,135 | A | | 5/1994 | Finocchio |
| 5,326,104 | A | | 7/1994 | Pease et al. |
| 5,332,219 | A | | 7/1994 | Marnell, II et al. |
| 5,342,047 | A | | 8/1994 | Heidel et al. |
| 5,342,049 | A | | 8/1994 | Wichinsky et al. |
| 5,344,144 | A | | 9/1994 | Canon |
| 5,346,258 | A | | 9/1994 | Behn et al. |
| 5,380,007 | A | | 1/1995 | Travis et al. |
| 5,393,057 | A | | 2/1995 | Marnell, II et al. |
| 5,401,024 | A | | 3/1995 | Simunek |
| 5,403,039 | A | | 4/1995 | Borowski, Jr. et al. |
| 5,407,199 | A | | 4/1995 | Gumina |
| 5,420,406 | A | | 5/1995 | Izawa et al. |
| 5,432,005 | A | | 7/1995 | Tanigami et al. |
| 5,451,052 | A | | 9/1995 | Behm et al. |
| 5,453,602 | A | | 9/1995 | Hanada |
| 5,456,465 | A | | 10/1995 | Durham |
| 5,471,040 | A | | 11/1995 | May |
| 5,475,205 | A | | 12/1995 | Behm et al. |
| 5,486,005 | A | | 1/1996 | Neal |
| 5,513,846 | A | | 5/1996 | Niederlien et al. |
| 5,528,154 | A | | 6/1996 | Leichner et al. |
| 5,536,016 | A | | 7/1996 | Thompson |
| 5,540,442 | A | | 7/1996 | Orselli et al. |
| 5,548,110 | A | | 8/1996 | Storch et al. |
| 5,550,746 | A | | 8/1996 | Jacobs |
| 5,560,610 | A | | 10/1996 | Behm et al. |
| 5,564,700 | A | | 10/1996 | Celona |
| 5,564,977 | A | | 10/1996 | Algie |
| 5,591,956 | A | | 1/1997 | Longacre, Jr. et al. |
| 5,599,046 | A | | 2/1997 | Behm et al. |
| 5,602,381 | A | | 2/1997 | Hoshino et al. |
| 5,621,200 | A | | 4/1997 | Irwin et al. |
| 5,628,684 | A | | 5/1997 | Bouedec |
| 5,630,753 | A | | 5/1997 | Fuchs |
| 5,651,735 | A | | 7/1997 | Baba |
| 5,655,961 | A | | 8/1997 | Acres et al. |
| 5,664,998 | A | | 9/1997 | Seelig et al. |
| 5,667,250 | A | | 9/1997 | Behm et al. |
| 5,682,819 | A | | 11/1997 | Beaty |
| 5,690,366 | A | | 11/1997 | Luciano |
| 5,704,647 | A | | 1/1998 | Desbiens |
| 5,722,891 | A | | 3/1998 | Inoue |
| 5,726,898 | A | | 3/1998 | Jacobs |
| 5,732,948 | A | | 3/1998 | Yoseloff |
| 5,741,183 | A | | 4/1998 | Acres et al. |
| 5,743,800 | A | | 4/1998 | Huard et al. |
| 5,752,882 | A | | 5/1998 | Acres et al. |
| 5,756,220 | A | | 5/1998 | Hoshino et al. |
| 5,768,142 | A | | 6/1998 | Jacobs |
| 5,769,458 | A | | 6/1998 | Carides et al. |
| 5,770,533 | A | | 6/1998 | Franchi |
| 5,772,509 | A | | 6/1998 | Weiss |
| 5,772,510 | A | | 6/1998 | Roberts |
| 5,772,511 | A | | 6/1998 | Smeltzer |
| RE35,864 | E | | 7/1998 | Weingardt |
| 5,779,840 | A | | 7/1998 | Boris |
| 5,789,459 | A | | 8/1998 | Inagaki et al. |
| 5,791,990 | A | | 8/1998 | Schroeder et al. |
| 5,797,794 | A | | 8/1998 | Angell |

| | | | | |
|---|---|---|---|---|
| 5,803,504 | A | 9/1998 | Deshiens et al. | |
| 5,816,920 | A | 10/1998 | Hanai | |
| 5,818,019 | A | 10/1998 | Irwin, Jr. et al. | |
| 5,820,459 | A | 10/1998 | Acres et al. | |
| 5,823,874 | A | 10/1998 | Adams | |
| 5,830,063 | A | 11/1998 | Byrne | |
| 5,830,066 | A | 11/1998 | Goden et al. | |
| 5,830,067 | A | 11/1998 | Graves et al. | |
| 5,833,537 | A | 11/1998 | Barrie | |
| 5,835,576 | A | 11/1998 | Katz | |
| 5,836,086 | A | 11/1998 | Elder | |
| 5,836,817 | A | 11/1998 | Acres et al. | |
| 5,848,932 | A | 12/1998 | Adams | |
| 5,863,075 | A | 1/1999 | Rich et al. | |
| 5,871,398 | A | 2/1999 | Schneier et al. | |
| 5,876,284 | A | 3/1999 | Acres et al. | |
| 5,882,261 | A | 3/1999 | Adams | |
| 5,883,537 | A | 3/1999 | Luoni et al. | |
| 5,885,158 | A | 3/1999 | Torango et al. | |
| 5,887,906 | A | 3/1999 | Sultan | |
| 5,903,340 | A | 5/1999 | Lawandy et al. | |
| 5,911,418 | A | 6/1999 | Adams | |
| 5,915,588 | A | 6/1999 | Stoken et al. | |
| 5,934,671 | A | 8/1999 | Harrison | |
| 5,970,143 | A | 10/1999 | Schneier et al. | |
| 5,979,894 | A | 11/1999 | Alexoff | |
| 5,996,997 | A | 12/1999 | Kamille | |
| 5,997,044 | A | 12/1999 | Behm et al. | |
| 6,004,207 | A | 12/1999 | Wilson, Jr. et al. | |
| 6,007,162 | A | 12/1999 | Hinz et al. | |
| 6,012,982 | A | 1/2000 | Piechowiak et al. | |
| 6,014,819 | A | 1/2000 | Maddix et al. | |
| 6,017,032 | A | 1/2000 | Grippo et al. | |
| 6,024,641 | A | 2/2000 | Sarno | |
| 6,033,306 | A * | 3/2000 | De Souza | 463/18 |
| 6,033,307 | A | 3/2000 | Vancura | |
| 6,053,405 | A | 4/2000 | Irwin, Jr. et al. | |
| 6,077,162 | A | 6/2000 | Weiss | |
| 6,080,062 | A | 6/2000 | Olson | |
| 6,086,477 | A | 7/2000 | Walker et al. | |
| 6,089,978 | A | 7/2000 | Adams | |
| 6,099,407 | A | 8/2000 | Parker, Jr. et al. | |
| 6,102,400 | A | 8/2000 | Scott et al. | |
| 6,107,913 | A | 8/2000 | Gatto et al. | |
| 6,119,364 | A | 9/2000 | Maddix et al. | |
| 6,125,368 | A | 9/2000 | Bridge et al. | |
| 6,142,872 | A | 11/2000 | Walker et al. | |
| 6,146,272 | A | 11/2000 | Walker et al. | |
| 6,149,521 | A | 11/2000 | Sanduski | |
| 6,155,491 | A | 12/2000 | Dueker et al. | |
| 6,168,521 | B1 | 1/2001 | Luciano et al. | |
| 6,168,522 | B1 | 1/2001 | Walker et al. | |
| 6,179,710 | B1 | 1/2001 | Sawyer et al. | |
| 6,203,429 | B1 | 3/2001 | Demar et al. | |
| 6,203,430 | B1 | 3/2001 | Walker et al. | |
| 6,206,373 | B1 | 3/2001 | Garrod | |
| 6,210,275 | B1 | 4/2001 | Olsen | |
| 6,217,448 | B1 | 4/2001 | Olsen | |
| 6,220,961 | B1 | 4/2001 | Keane et al. | |
| 6,224,055 | B1 | 5/2001 | Walker et al. | |
| 6,227,969 | B1 | 5/2001 | Yoseloff | |
| 6,238,288 | B1 | 5/2001 | Walker et al. | |
| 6,309,300 | B1 | 10/2001 | Glavich | |
| 6,312,334 | B1 | 11/2001 | Yoseloff | |
| 6,315,291 | B1 | 11/2001 | Moody | |
| 6,330,976 | B1 | 12/2001 | Dymetman et al. | |
| 6,331,143 | B1 | 12/2001 | Yoseloff | |
| 6,334,814 | B1 | 1/2002 | Adams | |
| 6,340,158 | B2 | 1/2002 | Pierce et al. | |
| 6,368,213 | B1 | 4/2002 | McNabola | |
| 6,375,568 | B1 | 4/2002 | Roffman et al. | |
| 6,379,742 | B1 | 4/2002 | Behm et al. | |
| 6,394,899 | B1 | 5/2002 | Walker et al. | |
| 6,398,214 | B1 | 6/2002 | Moteki et al. | |
| 6,398,643 | B1 | 6/2002 | Knowles et al. | |
| 6,398,644 | B1 | 6/2002 | Perrie et al. | |
| 6,398,645 | B1 | 6/2002 | Yoseloff | |
| 6,416,408 | B2 | 7/2002 | Tracy et al. | |
| 6,419,579 | B1 | 7/2002 | Bennett | |
| 6,435,408 | B1 | 8/2002 | Irwin, Jr. et al. | |
| 6,435,500 | B2 | 8/2002 | Gumina | |
| 6,478,677 | B1 | 11/2002 | Moody | |
| 6,491,215 | B1 | 12/2002 | Irwin, Jr. et al. | |
| 6,497,408 | B1 | 12/2002 | Walker et al. | |
| 6,552,290 | B1 | 4/2003 | Lawandy | |
| 6,588,747 | B1 | 7/2003 | Seelig | |
| 6,599,186 | B1 | 7/2003 | Walker et al. | |
| 6,601,772 | B1 | 8/2003 | Rubin et al. | |
| 6,637,747 | B1 | 10/2003 | Garrod | |
| 6,648,735 | B2 | 11/2003 | Miyashita et al. | |
| 6,648,753 | B1 | 11/2003 | Tracy et al. | |
| 6,648,755 | B1 | 11/2003 | Luciano et al. | |
| 6,676,126 | B1 | 1/2004 | Walker et al. | |
| 6,692,354 | B2 | 2/2004 | Tracy et al. | |
| 6,702,047 | B2 | 3/2004 | Huber | |
| 6,773,345 | B2 | 8/2004 | Walker et al. | |
| 6,776,337 | B2 | 8/2004 | Irwin, Jr. et al. | |
| 6,786,824 | B2 | 9/2004 | Cannon | |
| 6,793,219 | B2 * | 9/2004 | Higginson | 273/269 |
| 6,823,874 | B2 | 11/2004 | Lexcen | |
| 6,830,514 | B2 * | 12/2004 | Meyer et al. | 463/17 |
| 6,875,105 | B1 | 4/2005 | Behm et al. | |
| 6,929,186 | B2 | 8/2005 | Lapstun | |
| 2001/0027130 | A1 | 10/2001 | Namba et al. | |
| 2001/0030978 | A1 | 10/2001 | Holloway et al. | |
| 2001/0034262 | A1 | 10/2001 | Banyai | |
| 2001/0040345 | A1 | 11/2001 | Au-Yeung | |
| 2002/0022511 | A1 | 2/2002 | Eklund et al. | |
| 2002/0084335 | A1 | 7/2002 | Ericson | |
| 2002/0171201 | A1 | 11/2002 | Au-Yeung | |
| 2002/0187825 | A1 | 12/2002 | Tracy et al. | |
| 2003/0027621 | A1 * | 2/2003 | Libby et al. | 463/17 |
| 2003/0050109 | A1 | 3/2003 | Caro et al. | |
| 2003/0114210 | A1 | 6/2003 | Meyer et al. | |
| 2003/0119580 | A1 | 6/2003 | McClintic et al. | |
| 2004/0076310 | A1 | 4/2004 | Hersch et al. | |
| 2004/0173965 | A1 | 9/2004 | Stanek | |
| 2004/0178582 | A1 | 9/2004 | Garrod | |
| 2004/0185931 | A1 | 9/2004 | Hartman et al. | |
| 2004/0204222 | A1 | 10/2004 | Roberts | |
| 2004/0259631 | A1 | 12/2004 | Katz et al. | |
| 2004/0266514 | A1 | 12/2004 | Penrice | |

FOREIGN PATENT DOCUMENTS

| | | |
|---|---|---|
| AU | B-21070/92 | 7/1993 |
| AU | A-50327/96 | 2/1997 |
| AU | B-52499/96 | 2/1997 |
| AU | 199716432 B2 | 9/1997 |
| AU | A-45403/97 | 4/1998 |
| AU | A-63553/98 | 10/1998 |
| DE | 2938307 C2 | 4/1981 |
| DE | 3035898 A1 | 4/1982 |
| DE | 3035947 A1 | 5/1982 |
| DE | 29803107 U1 | 8/1988 |
| DE | 3822636 A1 | 1/1990 |
| DE | 2938307 C3 | 8/1990 |
| DE | 3415114 A1 | 10/1995 |
| DE | 19646956 C1 | 5/1998 |
| DE | 19706286 A1 | 5/1998 |
| DE | 29816453 U1 | 4/1999 |
| DE | 19751746 A1 | 5/1999 |
| EP | 0122902 B1 | 4/1984 |
| EP | 0333934 A1 | 9/1989 |
| EP | 0458623 | 11/1991 |
| EP | 0798676 A1 | 10/1997 |

| | | | |
|---|---|---|---|
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO0193966 | * | 12/2001 |
| WO | WO02/056266 | A1 | 7/2002 |

OTHER PUBLICATIONS

'Beginner's Guide-How To Bet', (www.plimico.com/How+to+wager/beginnersguide/), (Internet Article), 3 Pgs.
Chip Brown, 'Austin American-Statesman', (Article), May 28, 1998, 2 Pgs., Texas.
John C. Hallyburton, Jr., 'Frequently Asked Questions About Keno', (Internet Article),1995, 1998, 10 Pgs., (http://conielco.com/faq/keno.html).
'Horse betting Tutorial-Types of Bets' (www.homepokergames.com/horsebettingtutorial.php), (Internet Article), 2 Pgs.
Judith Gaines, 'Pool Party Betting Business Booming Throughout Area Workplaces', (Internet Article), Mar. 19, 1994, 2 Pgs., Issue 07431791, Boston Globe, Boston, MA.
'Maryland Launches Let It Ride', (Internet Article), Circa 2001,1 Pg.
'Notice of Final Rulemaking', (Internet Article) Mar. 24, 2000, 10 Pgs., vol. 6, Issue #13, Arizona Administrative Register, Arizona.
'How to Play Megabucks', (Internet Article), Mar. 9, 2001, 2 Pgs., Oregon Lottery Megabucks,(http://www.oregonlottery.org/mega/m_howto.htm).
'How to Play Megabucks', (Internet Article), May 8, 2001, 2 Pgs., Oregon Lottery Megabucks, (http://www.oregonlottery.org/mega/m_howto.htm).
'Oregon Lottery', (Internet Article), Apr. 30, 2004, 9 Pgs., Oregon Lottery Web Center, (http://www.oregonlottery.org/general/g_hist.shtml).
'Powerball Odd & Prizes', 'How to Play Powerball', (Internet Article),Dec. 2002, 2 Pgs., (www.powerball.com/pbhowtoplay.shtm).
'Powerball Prizes and Odds', (Internet Article), 2 Pgs., http://www.powerball.com/pbprizesNOdds.shtm.
'Learn to Play the Races' (Internet Article), 15 Pgs., Racing Daily Form (www.drf.com).
Mike Parker, 'The History of Horse Racing' (Internet Article),1996, 1997,1998, 5 Pgs., http://www.mrmike.com/explore/hrhist.htm.
PCT US06/00990 Written Opinion and Search Report Sep. 11, 2007.

* cited by examiner

200

Up2u UP-TO-YOU Up2u $1.00

Your numbers

| Yellow | Red | Blue | Green |
|---|---|---|---|
| 11 | 23 | 44 | 50 |

No Extra Balls

FIG. 2a

250

Up2u UP-TO-YOU Up2u $3.00

Your numbers

| Yellow | Red | Blue | Green |
|---|---|---|---|
| 11 | 23 | 44 | 50 |
| | Extra Ball | Extra Ball | |

Two Extra Balls

FIG. 2b

280

Up2u UP-TO-YOU Up2u $5.00

Your numbers

| Yellow | Red | Blue | Green |
|---|---|---|---|
| 11 | 23 | 44 | 50 |
| Extra Ball | Extra Ball | Extra Ball | Extra Ball |

Four Extra Balls

FIG. 2c

300

| | No Extra Balls | | | 2 Extra Balls | | | All 4 Extra Balls | | |
|---|---|---|---|---|---|---|---|---|---|
| | $1 Wager | | | $3 Wager | | | $5 Wager | | |
| Matches | Odds | Prize | Return | Odds | Prize | Return | Odds | Prize | Return |
| 4 | 1 in 50,625.0 | $500 | 1.0% | 1 in 12,656.3 | $500 | 1.3% | 1 in 3,164.1 | $500 | 3.2% |
| 3 | 1 in 904.0 | $50 | 5.5% | 1 in 308.7 | $50 | 5.4% | 1 in 121.7 | $50 | 8.2% |
| 2 | 1 in 43.0 | $10 | 23.2% | 1 in 21.0 | $10 | 15.9% | 1 in 12.5 | $10 | 16.0% |
| 1 | 1 in 4.6 | $1 | 21.7% | 1 in 3.4 | $1 | 29.5% | 1 in 2.9 | $1 | 34.7% |

FIG. 3

ON-LINE LOTTERY GAME IN WHICH SUPPLEMENTAL LOTTERY-SELECTED INDICIA ARE AVAILABLE FOR PURCHASE

RELATED APPLICATION

This application claims the benefit of U.S. Provisional Application No. 60/642,960, On-line Lottery Game In Which Supplemental Lottery-selected Indicia Are Available For Purchase, filed on Jan. 11, 2005, the specification of which is hereby incorporated in its entirety by this reference.

BACKGROUND OF THE INVENTION

1. Field of the Invention

The invention relates generally to a system and method for implementing a lottery game, and more particularly to a lottery game in which supplementary indicia are drawn which are available only to players who have wagered more than the minimum amount required to play the game.

2. Description of the Related Art

Many governments and/or gaming organizations sponsor wagering games known as lotteries. A typical lottery game entails players selecting permutations or combinations of numbers. This is followed by a "draw," wherein the lottery randomly selects a combination or permutation of numbered balls. Prizes are awarded based on the number of matches between a player's selection and the drawn numbers. The drawn numbers are the well-publicized, and multi-million-dollar-jackpot lotteries are popular throughout the world.

Lotteries have become an important source of income to governments as they shoulder much of the financial burden for education and other programs. However, as governments have grown more dependent on lotteries, it has become a challenge to increase sales, particularly for on-line games, i.e. games in which player-selected indicia are sent through a terminal to a central system and subsequently compared to lottery-selected indicia to determine if the player has won a prize. One approach for invigorating lottery sales for on-line drawing games is to offer games in which the player has the opportunity to make an additional wager beyond the minimum amount required to play the game. This, in turn, requires that the game be structured in such a way that it is readily apparent to the player that the additional wager provides added value. Thus, there is a need for a lottery game in which players who make a minimum wager will often have the experience of concretely seeing that they could have had a better outcome had they made a larger wager.

SUMMARY OF THE INVENTION

Briefly describing, the invention teaches a lottery game with a supplemental game. A player plays the lottery game by selecting a set of numbers and can also opt to play the supplemental game. The winning numbers for the lottery game are drawn along with a set of supplemental numbers. The player can win the lottery game by matching his select numbers with the winning numbers for the lottery game. The player can also increase his winning chance by matching his select numbers with the supplemental numbers if he has opted to play the supplemental game.

In one embodiment, the invention comprises a lottery game in which the player selects a plurality of indicia from a set of indicia and also chooses how many of the plurality of indicia to be drawn by the lottery will be compared to the player-selected indicia for the purpose of prize determination, where the amount of the wager and the magnitude of the prizes depend on the player's choice of how many lottery-selected indicia are to be matched to the player-selected indicia.

In one embodiment, there is provided a method of playing a lottery game. The method includes the steps of receiving a first plurality of game indicia selected from a plurality of sets, receiving an indication of supplemental selection, receiving a second plurality of game indicia selected from the plurality of sets, receiving a supplemental plurality of game indicia selected from the plurality of sets, determining a first number of matches between the first plurality of game indicia and the second plurality of game indicia and determining a total number of matches according to the first number of matches and the indication of supplemental selection.

In another embodiment, there is provided a system for playing a lottery game. The system includes a communication network, at least one gaming machine in communication with the communication network, and a server in communication with the at least one gaming machine through the communication network. The server hosts the lottery game and is capable of receiving a first plurality of game indicia selected from a plurality of sets, receiving an indication of supplemental selection, receiving a second plurality of game indicia selected from the plurality of sets, receiving a supplemental plurality of game indicia selected from the plurality of sets, determining a first number of matches between the first plurality of game indicia and the second plurality of game indicia, and determining a total number of matches according to the first number of matches and the indication of supplemental selection.

BRIEF DESCRIPTION OF THE DRAWINGS

FIGS. 2A, 2B, and 2C are embodiments of lottery game tickets of the present invention.

FIG. 3 is an embodiment of lottery game prize table of the present invention.

DETAILED DESCRIPTION

Figure 1A:
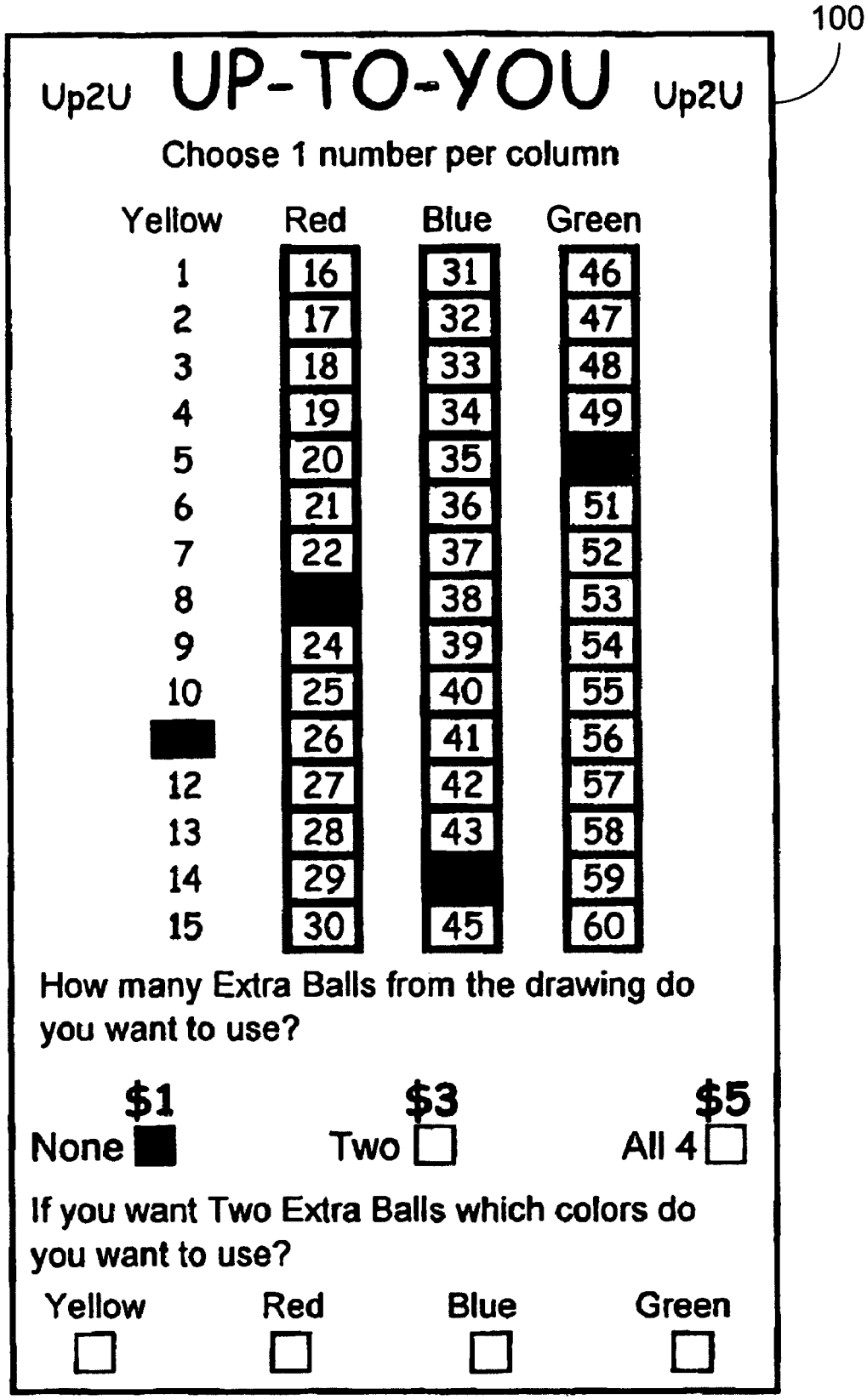
FIGS. 1A, 1B, and 1C are embodiments of lottery game playslips of the present invention.

In one embodiment, the invention is a lotto-style game. That is, the game comprises a player selecting indicia from a plurality of sets of indicia and submitting his selections along with a wager to a lottery system, either through a retailer operating a lottery terminal or through a self-serve kiosk. Alternatively, the player may request that the lottery system select the indicia for him as in a quick-pick option. Henceforth, it will be assumed the player has selected his own indicia. After sales for the game are closed, a drawing is held in which the lottery selects indicia from the same sets. Players may win prizes based on the number of matches between the indicia they selected and the indicia selected in the draw.

The plurality of indicia selected by the lottery from each of the sets is strictly greater than the plurality selected by the player from the corresponding set. The lottery selects its indicia from each set in a specific order. In order to match player-selected indicia with indicia selected by the lottery in excess of the plurality of player-selected indicia, the player must pay an additional amount according to a fixed schedule. Thus the player's entry must include an indication of how many of the lottery-selected indicia are to be matched with the player-selected indicia, along with a wager of the required amount.

A sample embodiment may be described as follows. At the time of purchase, the player selects one number for each of the four sets {1, 2, . . . , 15}, {16, 17, . . . , 30}, {31, 32, . . . , 45}, and {46, 47, . . . , 60}. These sets are associated with the colors yellow, red, blue, and green, respectively. At the time of the drawing the lottery will select two distinct numbers from each of these sets, in order and without replacement. Henceforth, we will refer to the first number selected from each set as a "primary" number, and we will refer to the second number selected from each set as a "supplementary" number. For the basic wager of $1 the player may match his numbers only with the primary numbers selected by the lottery. For a $3 wager, the player may also match his numbers with two supplementary numbers of his choosing as well as the primary numbers, and for $5 the player may match his numbers with any of the lottery-selected numbers, be they primary or supplementary. The player may express his intentions by filling out the playslip shown in FIGS. 1A to 1C, as will be explained below.

FIG. 1A illustrates a playslip 100. The upper portion of the playslip 100 comprises four columns, corresponding to the four sets of numbers from which the player and the lottery will choose. These columns are labeled with the colors of their corresponding sets. The player marks exactly one number in each column, indicating his choices. He also marks the amount of his wager, $1, $3, or $5.

The playslip 100 of FIG. 1A shows that the player has chosen the numbers 11, 23, 44, and 50 also made a $1 wager. This is all the information that is required from a player making a $1 wager. FIG. 2A shows a ticket 200 that may be issued to a player as a result of filling out the playslip 100 as shown in FIG. 1A. The ticket lists the player's selections and also gives an indication that the player is not eligible to match his numbers with any of the supplementary numbers.

Figure 1B:
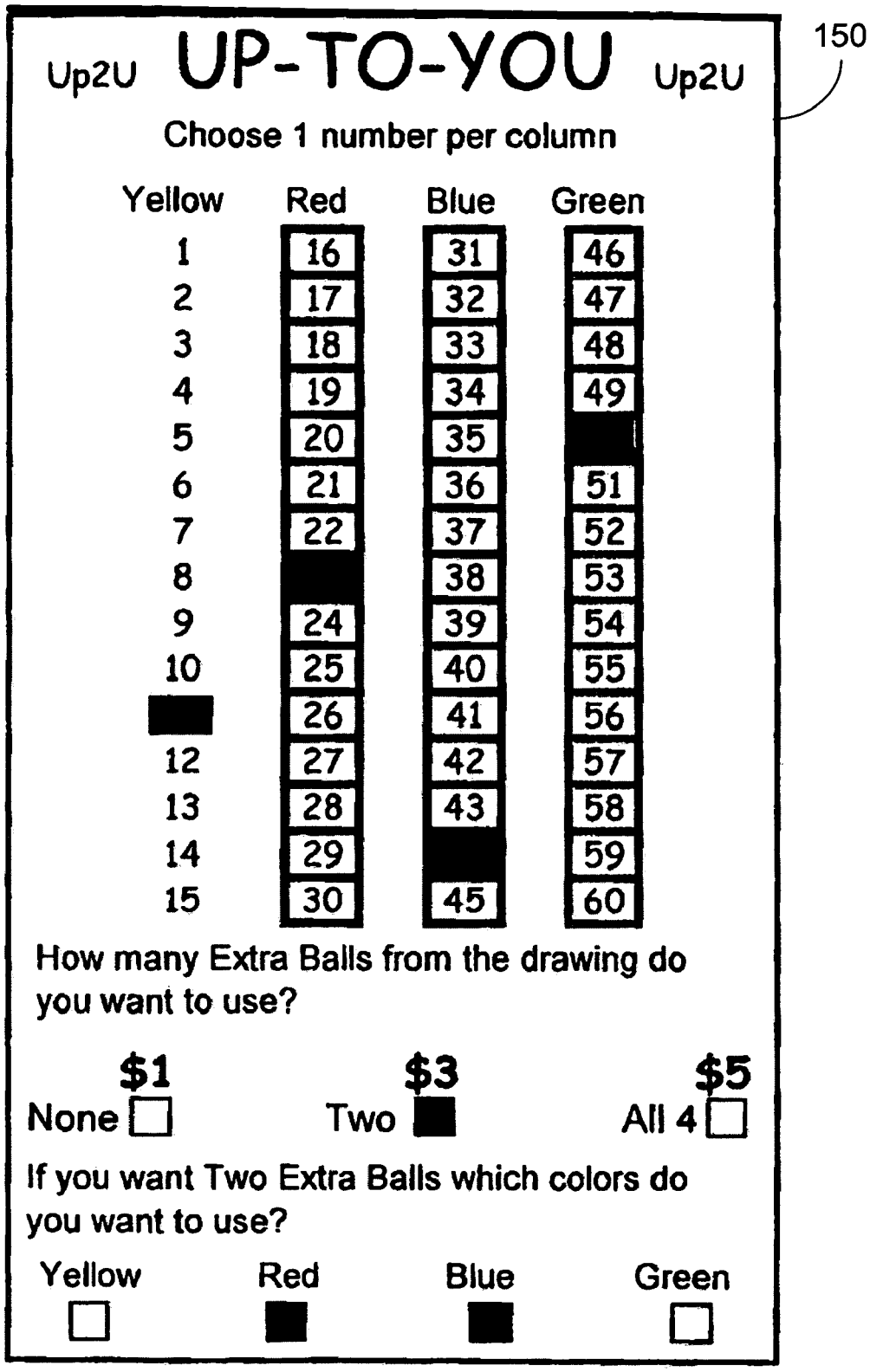

FIG. 1B shows a playslip 150 of a player who has chosen the numbers 11, 23, 44, and 50 and also made a $3 wager. Because the $3 wager entitles the player to match his numbers with the primary numbers and exactly two of the supplementary numbers, the player must indicate which supplementary numbers he wishes to use. Since there will be exactly one supplementary number of each of the colors yellow, red, blue, and green, it suffices for the player to select two of these colors. In the case the players has selected red and blue. FIG. 2B shows a ticket 250 that may be issued to a player as a result of filling out the playslip 150 as shown in FIG. 1B. The ticket 250 lists the player's selections and also gives an indication that the player is eligible to match his numbers with the red and blue supplementary numbers.

Figure 1C:
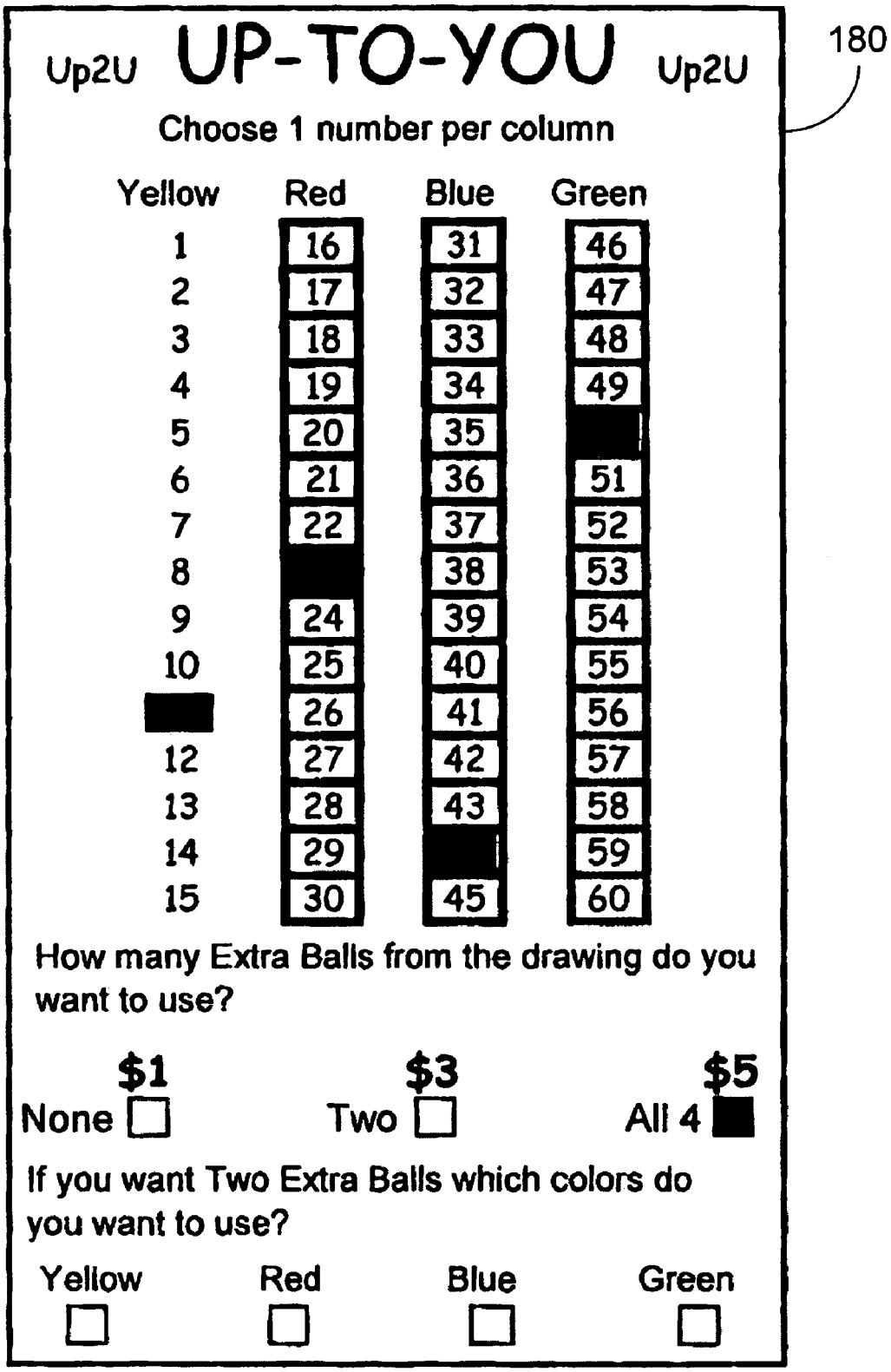

FIG. 1C shows a playslip 180 of a player who has chosen the numbers 11, 23, 44, and 50 and also made a $5 wager. This is all the information that is required of a player making a $5 wager. FIG. 2C shows a ticket 280 that may be issued to a player as a result of filling out the playslip 180 as shown in FIG. 1C. The ticket lists the player's selections and also gives an indication that the player is eligible to match his numbers with all of the supplementary numbers.

Alternatively, the player may express his intentions verbally to a retailer operating a lottery terminal or by use of a self-service kiosk interface or a computer terminal connected to a centralized lottery server. The player's selection of numbers, as well as the colors of the supplementary colors in the case of a $3 wager, may also be randomly selected by the lottery terminal using technology well-known in the art.

FIG. 3 shows a possible prize table 300 for this embodiment. We will demonstrate how to use the table 300 by evaluating each of the three game entries described above. Suppose the lottery has selected primary numbers 11, 29, 40, and 54; and supplementary numbers 9, 23, 36, and 50. In this case the ticket in FIG. 2A would be credited with one match, the 11. Therefore this ticket would win a prize of $1.

Given the same lottery selection, the ticket in FIG. 2B would be credited with two matches, the 11 and the 23, because the player-selected numbers may be matched with the red and blue supplementary numbers as well as the primary numbers. Therefore this ticket would win a prize of $10.

Given the same lottery selection, the ticket in FIG. 2C would be credited with three matches, the 11, the 23, and the 50, because the player-selected numbers may be matched with any of the supplementary numbers as well as the primary numbers. Therefore this ticket would win a prize of $50.

In an alternative embodiment, the player may choose a predetermined numbers from one single large set of numbers. For example, the player may choose {2, 5, 6, 20, 35} from a set of numbers 1-50. The lottery authority will choose a set of winning numbers and a set of supplemental numbers from the same set of numbers. For example, the winning numbers may be {7, 8, 9, 20, 40} and the supplemental numbers may be {2, 11, 21, 35, 49}. The player plays the supplemental game by indicating how many supplemental numbers he wants to play. If the player plays one supplemental number, then his five numbers will be compared with the five winning numbers plus one of the supplemental numbers. In the example based on the numbers above, the player matches one winning number, 20. If the player plays one supplemental number, then the player would match two numbers, {20, 2} or {20, 35}. If the player plays two supplemental number, he would match three numbers, {20, 2, 35}.

Figure 4:
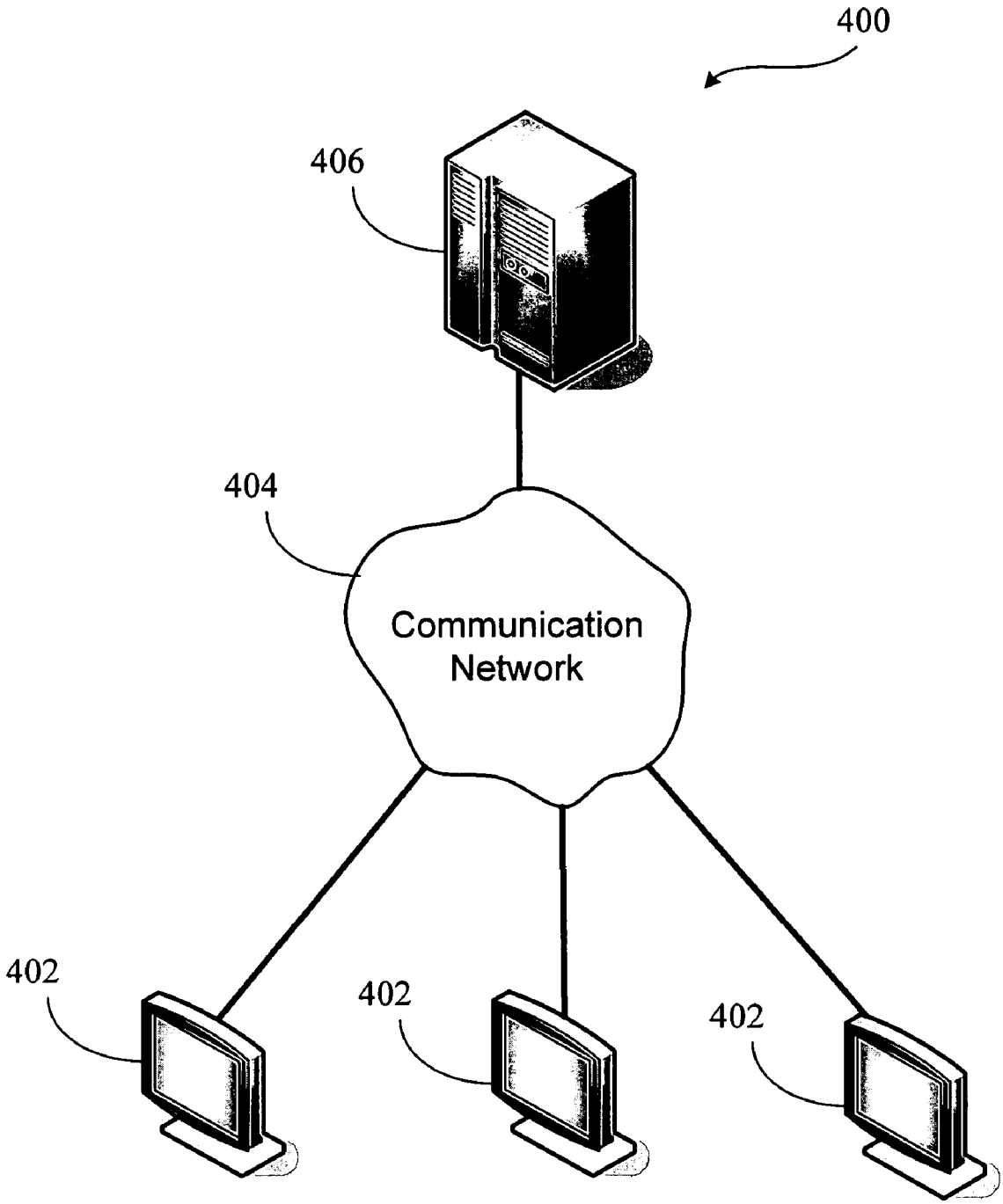
FIG. 4 illustrates one embodiment of a network architecture supporting the present invention.

The invention can be implemented on a standalone gaming machine or a game server. A standalone gaming device may include a display unit, a scanning unit (also known as a player input device) for scanning playslips containing player selection, and a ticket issuing unit for issuing tickets to players. The gaming device has a controller with a random number generator capable of performing quick picks for the player. The controller also takes player bets from the scanning device and issues a ticket to the player. After issuing the ticket, the controller generates a set of winning numbers and a set of supplemental numbers, and determines a number of matches for the player's ticket as described above. The gaming device may also be connected to a game server as illustrated in FIG. 4. The gaming device 402 is connected to the server 406 through a communication network 404. In the embodiment illustrated in FIG. 4, each gaming device receives wagers and selections from players, passes betting information to the server 406, and issues tickets to the players. The server 406 receives player selections and determines winners based on the numbers selected by the lottery authority.

Figure 5:
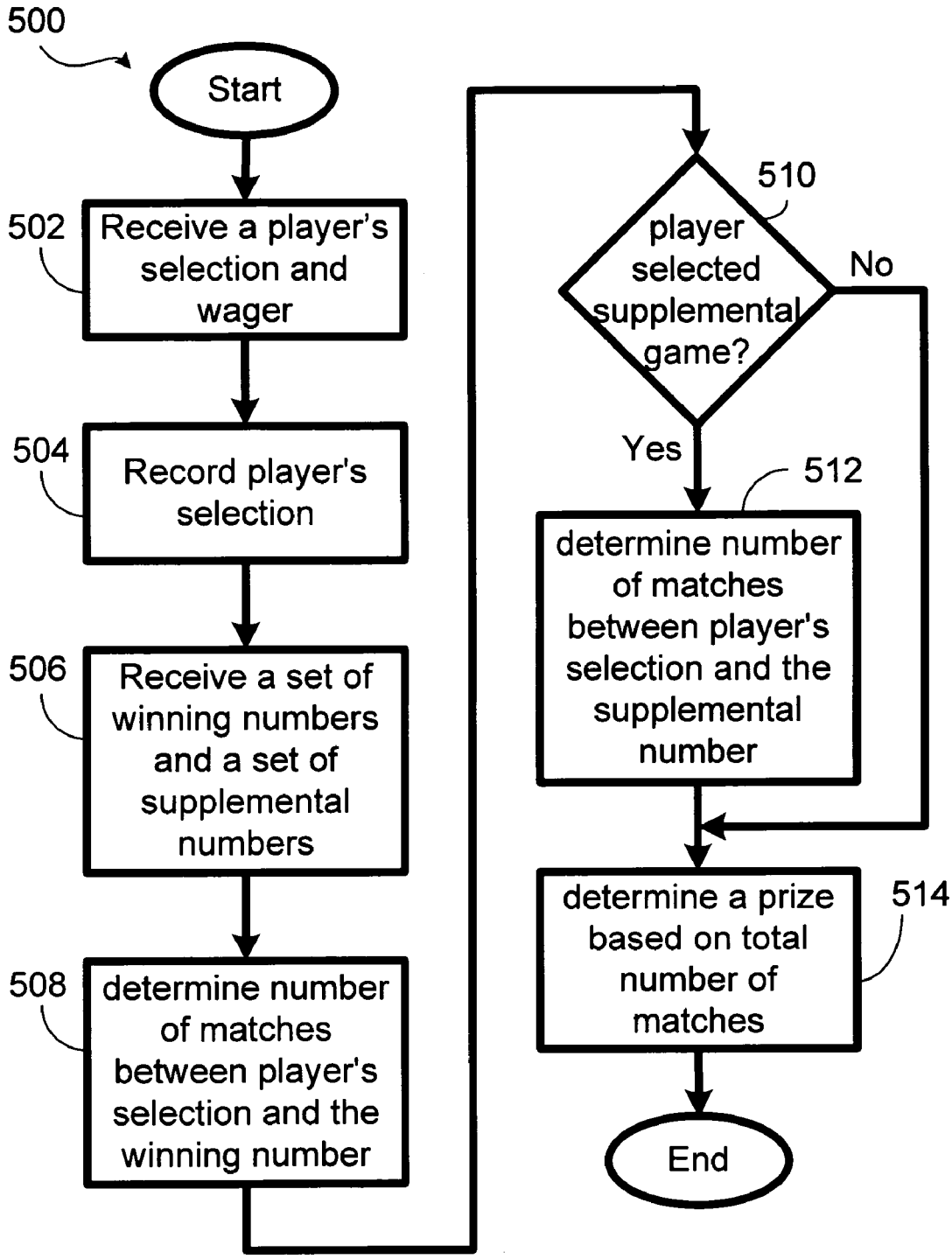
FIG. 5 illustrates one embodiment of a lottery server process.

FIG. 5 illustrates an exemplary flow chart 500 for a game server process. A player can place a wager on a lottery game by selecting a set of number and he can also indicate whether he wants to increase his chance of winning by participating in a supplemental game. The player may play the lottery game at a standalone lottery station or at a computer terminal connected to a lottery server through a communication network. The player's wager information and game selection are received by the lottery server, step 502 and the lottery server will record the information received, step 504.

At a predetermined time, the lottery authority holds a drawing of winning numbers. Besides drawing the winning numbers, the lottery authority also draws a set of supplemental numbers. Alternatively, the winning numbers and the supplemental numbers can be generated automatically by a random number generator or manually drawn by a third party. Both the winning numbers and supplemental numbers are provided to the lottery server, step 506. Alternatively, the winning numbers and supplemental numbers can be randomly generated by the lottery server or the standalone lottery station. After the winning numbers and supplemental numbers are determined, the lottery server determines number of matches between the numbers selected by the player and the winning numbers, step 508. The lottery server also checks whether the player has purchased the supplemental game, step 510. If the player has opted to play the supplemental game, the player's numbers are compared with the supplemental numbers received by the lottery server, step 512. Finally, the lottery server determines a total number of matches for the player's ticket, and the player wins a prize if the total number of matches is listed in the prize table.

In the context of FIG. 5, the method may be implemented, for example, by operating a computer to execute a sequence of machine-readable instructions. The instructions can reside in various types of signal-bearing or data storage primary, secondary, or tertiary media. The media may comprise, for example, RAM (not shown) accessible by, or residing within, the components of the wireless network. Whether contained in RAM, a diskette, or other secondary storage media, the instructions may be stored on a variety of machine-readable data storage media, such as DASD storage (e.g., a conventional "hard drive" or a RAID array), magnetic tape, electronic read-only memory (e.g., ROM, EPROM, or EEPROM), flash memory cards, an optical storage device (e.g. CD-ROM, WORM, DVD, digital optical tape), paper "punch" cards, or other suitable data storage media including digital and analog transmission media.

While the invention has been particularly shown and described with reference to one embodiment thereof, it will be understood by those skilled in the art that various changes in form and detail may be made without departing from the spirit and scope of the present invention as set forth in the following claims. Though, the method in FIG. 5 is illustrated in sequential steps, those skilled in the art will appreciate the different sequences may also be used to implement the invention. Furthermore, although elements of the invention may be described or claimed in the singular, the plural is contemplated unless limitation to the singular is explicitly stated.

The invention claimed is:

1. A method for playing a lottery game with a plurality of game machines in communication with a game server via a communications network, comprising the steps of:

receiving a wager and a first plurality of primary player indicia from a player via one of the game machines for play in a single lottery game;

receiving an indication from the player via the game machine of selection of an option to play one or more supplemental game indicia in the single lottery game for an increased wager by the player;

wherein the wager increases as a function of the number of supplemental game indicia selected to be played by the player;

randomly generating a plurality of primary game indicia via the server for play of the single lottery game;

randomly generating a plurality of supplemental game indicia via the server also for play of the single lottery game;

determining a first number of matches between the plurality of primary game indicia and the plurality of primary player indicia;

determining a second number of matches between the supplemental game indicia and the plurality of primary player indicia;

determining a total number of matches for the player in play of the single lottery game according to the first number of matches and any of the second number of matches the player is entitled to as a result of the player's option to play one or more of the supplemental game indicia; and awarding a prize to the player for play of the single lottery game based on the total number of matches.

2. The method for playing a lottery game of claim 1, wherein the plurality of primary game indicia is selected from a plurality of sets, wherein one primary game indicia is selected from each of the plurality of sets, the plurality of primary player indicia is selected from the plurality of sets, wherein one primary player indicia is selected from each of the plurality of sets, and the supplemental plurality of game indicia is selected from the plurality of sets, wherein one supplemental game indicia is selected from each of the plurality of sets.

3. The method for playing a lottery game of claim 1, wherein the step of randomly generating a plurality of primary game indicia further comprises the step of obtaining the plurality of primary game indicia from a third party.

4. The method for playing a lottery game of claim 1, wherein the step of randomly generating a plurality of primary game indicia further comprises the step of generating the primary game indicia from a random number generator.

5. A system for playing a lottery game, comprising:

a communication network;

at least one gaming machine in communication with the communication network; and a server in communication with the at least one gaming machine through the communication network, wherein the server hosts the lottery game and is capable of receiving a wager and a first plurality of primary player indicia from the at least one game machine for play in a single lottery game;

receiving an indication from the at least one game machine of selection of an option to play one or more supplemental game indicia in the single lottery game for an increased wager;

wherein the wager increases as a function of the number of supplemental game indicia selected for play by a player;

randomly generating a plurality of primary game indicia via the server for play of the single lottery game;

randomly generating a plurality of supplemental game indicia via the server also for play of the single lottery game;

determining a first number of matches between the plurality of primary game indicia and the plurality of primary player indicia;

determining a second number of matches between the supplemental game indicia and the plurality of primary player indicia;

determining a total number of matches for the player in play of the single lottery game according to the first number of matches and any of the second number of matches the player is entitled to as a result of the player's option to play one or more of the supplemental game indicia; and awarding a prize to the player for play of the single lottery game based on the total number of matches.

6. The system of claim 5, wherein the plurality of primary game indicia is selected from a plurality of sets, wherein one primary game indicia is selected from each of the plurality of sets, the plurality of primary player indicia is selected from the plurality of sets, wherein one primary player indicia is selected from each of the plurality of sets, and the supplemental plurality of game indicia is selected from the plurality of sets, wherein one supplemental game indicia is selected from each of the plurality of sets.

7. The system of claim 5, wherein the gaming machine issues to the player a ticket containing the plurality of primary player indicia and the indication of supplemental selection.

8. A system for playing a lottery game, comprising:

communication network means;

means for playing the lottery game in communication with the communication network means; and server means in communication with the means for playing the lottery game through the communication network means, wherein the server means hosts the lottery game and is capable of receiving a wager and a first plurality of primary player indicia from the means for playing the lottery game for play in a single lottery game;

receiving an indication from the means for playing the lottery game of selection of an option to play one or more supplemental game indicia in the single lottery game for an increased wager;

wherein the wager increases as a function of the number of supplemental game indicia selected for play by a player;

randomly generating a plurality of primary game indicia for play of the single lottery game;

randomly generating a plurality of supplemental game indicia for play of the single lottery game;

determining a first number of matches between the plurality of primary game indicia and the plurality of primary player indicia;

determining a second number of matches between the supplemental game indicia and the plurality of primary player indicia;

determining a total number of matches for the player in play of the single lottery game according to the first number of matches and any of the second number of matches the player is entitled to as a result of the player's option to play one or more of the supplemental game indicia; and awarding a prize to the player for play of the single lottery game based on the total number of matches.

* * * * *